US008793812B1

(12) United States Patent
Bada

(10) Patent No.: US 8,793,812 B1
(45) Date of Patent: Aug. 5, 2014

(54) MULTI-USE ACCESSORY PAD FOR INFANT CAREGIVER

(76) Inventor: Olivia Bada, Williamsburg, VA (US)

( * ) Notice: Subject to any disclaimer, the term of this patent is extended or adjusted under 35 U.S.C. 154(b) by 466 days.

(21) Appl. No.: 13/199,974

(22) Filed: Sep. 15, 2011

Related U.S. Application Data

(63) Continuation-in-part of application No. 12/584,469, filed on Sep. 4, 2009.

(60) Provisional application No. 61/192,186, filed on Sep. 17, 2008.

(51) Int. Cl.
*A41D 13/04* (2006.01)

(52) U.S. Cl.
CPC ..... *A41D 13/04* (2013.01)
USPC ..... 2/46; 2/48; 5/655

(58) Field of Classification Search
CPC ..... A41D 13/04; A47G 9/007; A47G 9/10
USPC ..... 5/630, 632, 655, 482, 484, 494, 502; 2/46, 48; D2/860, 861; D6/596, 601, D6/603, 382
See application file for complete search history.

(56) References Cited

U.S. PATENT DOCUMENTS

| | | | | | |
|---|---|---|---|---|---|
| 2,727,239 | A | * | 12/1955 | Simon | 2/49.2 |
| 2,955,293 | A | * | 10/1960 | Peterson | 2/48 |
| D236,063 | S | * | 7/1975 | Kesh | D6/601 |
| D255,854 | S | * | 7/1980 | Gay | D6/601 |
| D333,585 | S | * | 3/1993 | DeStefanis | D6/601 |
| D339,708 | S | * | 9/1993 | DeStefanis | D6/601 |
| D375,187 | S | * | 11/1996 | Shoemate | D2/861 |
| 5,572,740 | A | * | 11/1996 | Geniesse | 2/46 |
| D394,181 | S | * | 5/1998 | Mitchell | D6/603 |
| 6,769,144 | B1 | * | 8/2004 | Bruske | 5/482 |
| RE38,782 | E | * | 8/2005 | Dix | 5/482 |
| 7,765,609 | B2 | * | 8/2010 | Chase | 2/46 |
| 2008/0201815 | A1 | * | 8/2008 | Barclay | 2/48 |

* cited by examiner

*Primary Examiner* — Nicholas Polito
(74) *Attorney, Agent, or Firm* — Peter J. Van Bergen

(57) ABSTRACT

A multi-use accessory for an infant caregiver is an elongated fabric pad having first and second opposing edges with a first cut and second cut formed respectively therein. The first and second cuts are positioned at non-mirror-image locations that are along the first edge and second edge, respectively, and that are relative to a longitudinal axis of the pad. The first cut and the second cut are further separated by a distance measured along the pad's longitudinal axis. When the pad is draped over a caregiver's shoulder, one of the first and second cuts engages a portion of the caregiver's neck while a remaining one of the first and second cuts engages an upper portion of the caregiver's arm when the caregiver is supporting an infant against the pad with the arm.

20 Claims, 3 Drawing Sheets

MULTI-USE ACCESSORY PAD FOR INFANT CAREGIVER

ORIGIN OF THE INVENTION

This is a continuation-in-part of co-pending application Ser. No. 12/584,469, filed Sep. 4, 2009, that claims the benefit of priority from provisional application Ser. No. 61/192,186, with a filing date of Sep. 17, 2008.

FIELD OF THE INVENTION

The invention relates generally to accessories used when burping, nursing or changing an infant, and more particularly to a multi-use accessory pad that can be used by a caregiver when burping, nursing or changing the diaper of an infant.

BACKGROUND OF THE INVENTION

Conventional burp cloths and nursing covers can be simple rectangular cloths or can be specialized "garments that include straps of some kind to hold the garment in place. The simple rectangular cloths do not readily stay in place and/or tend to bunch up underneath the infant being held by a caregiver. The specialized strap-type garments are not readily secured with one hand as this is usually all a caregiver has free when holding an infant.

SUMMARY OF THE INVENTION

Accordingly, it is an object of the present invention to provide an accessory that is readily used by a caregiver during the burping or nursing process.

Another object of the present invention is to provide a multi-use accessory that can be used by a caregiver when burping, nursing, or changing an infant.

Other objects and advantages of the present invention will become more obvious hereinafter in the specification and drawings.

In accordance with the present invention, a multi-use accessory for an infant caregiver is provided. The accessory is an elongated fabric pad having first and second opposing edges. The first edge includes a first cut formed therein, and the second edge includes a second cut formed therein. The first cut and second cut are positioned at non-mirror-image locations that are along the first edge and second edge, respectively, and that are relative to a longitudinal axis of the pad that lies between the first edge and second edge. In this way, 180° of in-plane rotation of the pad causes the first cut and the second cut to exchange their locations. The first cut and the second cut are further separated by a distance measured along the pad's longitudinal axis. When the pad is draped over a caregiver's shoulder, one of the first cut and second cut engages a portion of the caregiver's neck while a remaining one of the first cut and second cut engages an upper portion of the caregiver's arm when the caregiver is supporting an infant against the pad with the arm.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
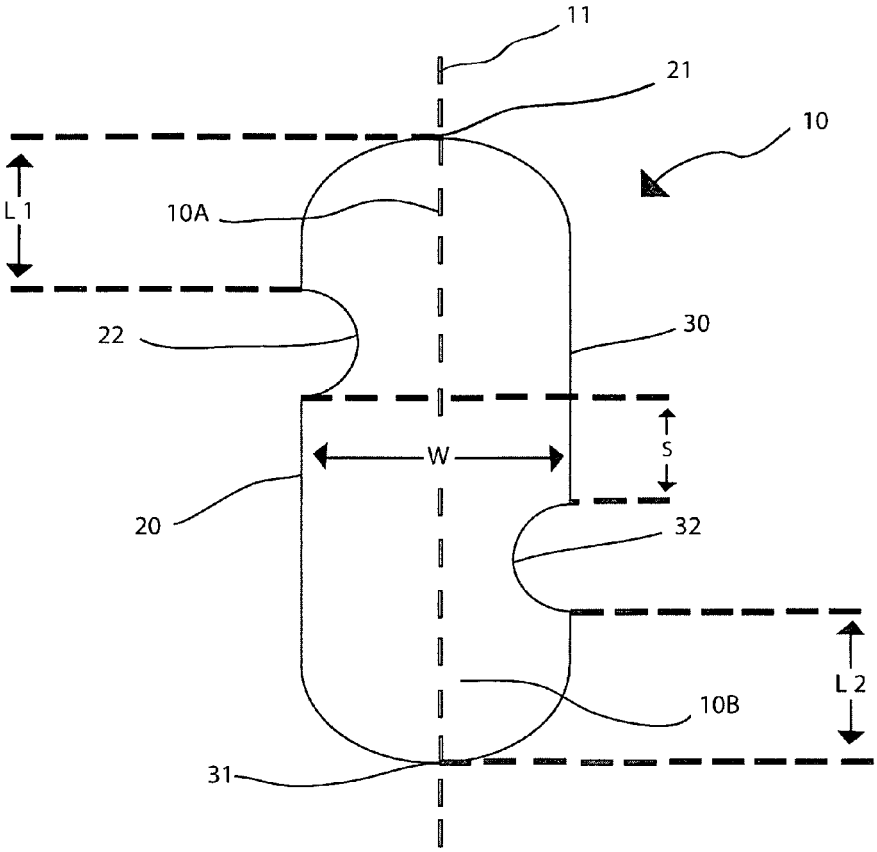
FIG. 1 is a plan view of a caregiver's multi-use accessory pad having semi-circular cuts in accordance with an embodiment of the present invention.

Referring now to the drawings and more particularly to FIG. 1, a plan view of a multi-use accessory pad in accordance with an embodiment of the present invention is shown and is referenced generally by numeral 10. As will be explained further herein, pad 10 is an ergonomic design that is particularly useful when a caregiver needs to burp or nurse an infant. In addition, pad 10 can also be used as a changing pad on which an infant lays when having his/her diaper changed.

Pad 10 is of flexible construction and is typically substantially rectangular in shape with opposing longitudinal or long-side edges 20 and 30 defining a width W that is typically large enough to allow an infant (not shown) to lie on pad 10 for diaper changing. While the opposing short-side ends 21 and 31 of pad 10 are illustrated as being rounded, the present invention is not so limited as other end shapes could be used without departing from the scope of the present invention. A cut in the form of a semi-circular notch is formed in each of edges 20 and 30 as indicated by reference numerals 22 and 32, respectively. Each of notches 22 and 32 can be identical in size and shape as illustrated. The size of each of notches 22 and 32 is large enough to cradle a caregiver's neck or portion of an arm therein as will be explained later herein. Notches 22 and 32 are positioned at non-mirror-image locations along edges 20 and 30, respectively. The non-mirror-image locations are relative to a longitudinal axis 11 of pad 10 that is centered between edges 20 and 30. In addition and for reasons that will be explained further below, notches 22 and 32 are separated by a distance "S" measured along longitudinal axis 11 where the value of S generally ranges from approximately 2 inches to approximately 4 inches. In accordance with this construction, when pad 10 is rotated 180° in the plane of pad 10 (i.e., in the plane of the paper in terms of the drawing of pad 10), notch 22 assumes the position of the illustrated position of notch 32 while notch 32 assumes the position of the illustrated position of notch 22. Note that this will be true regardless of how much of pad 10 (i.e., outside regions 10A and 10B) is on either side of notches 22 and 32. However and while not a requirement of the present invention, the distance "$L_1$" (as measured along longitudinal axis 11) from notch 22 to short-sided edge 21 can be made equal to the distance "$L_2$" (as measured along longitudinal axis 11) from notch 32 to short-side edge 31.

Figure 2A:
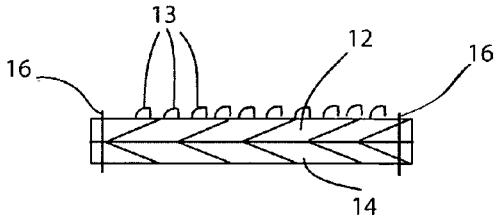
FIG. 2A is a cross-sectional view of the accessory pad taken along line 2-2 in FIG. 1 in accordance with a two-layer embodiment of the present invention.
Figure 2B:
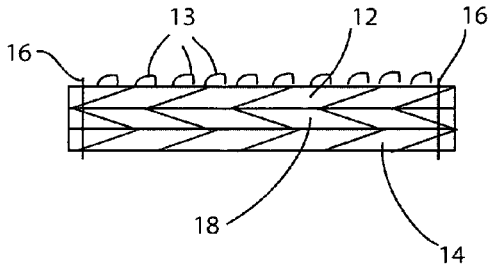
FIG. 2B is a cross-sectional view of the accessory pad taken along line 2-2 in FIG. 1 in accordance with a three-layer embodiment of the present invention.

As mentioned above, pad 10 is of flexible construction and is typically made from moisture-absorbing fabric(s) such as pure cotton fabrics (e.g., to include fabric types such as smooth cotton, cotton flannel, cotton terry cloth, etc.), as well as cotton blends of these fabric types. Pad 10 can be made from a single or multiple layers of the same or different materials without departing from the scope of the present invention. By way of example, two possible multi-layer constructions are illustrated in the cross-sectional views in FIGS. 2A and 2B. In FIG. 2A, a two-layer construction is illustrated where layers 12 and 14 are different fabrics. In the illustrated example, layer 12 is a terry cloth material (e.g., cotton, polyester/cotton, etc.) having loops 13 formed on at least the outer face of layer 12. Loops 13 improve the moisture absorbency of pad 10. The second layer 14 of pad 10 can be another moisture absorbent material such as those noted above. Note that second layer 14 could also be the same material as layer 12 (e.g., terry cloth) without departing from the scope of the present invention. Typically, layers 12 and 14 are joined only around the perimeter of pad 10 as indicated by stitch lines 16. A three-layer construction is illustrated in FIG. 2B where a moisture-impermeable layer 18 is disposed between layers 12 and 14. It is to be understood that additional layers can be used without departing from the scope of the present invention.

Figure 3:
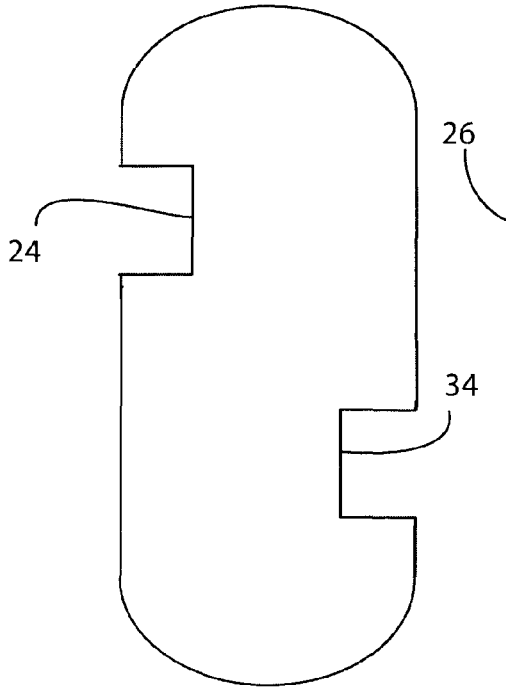
FIG. 3 is a plan view of an accessory pad having rectangular cuts in accordance with another embodiment of the present invention.
Figure 4:
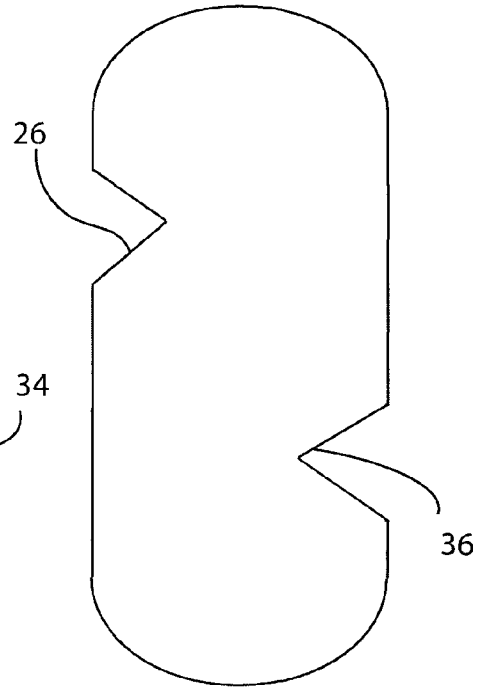
FIG. 4 is a plan view of an accessory pad having triangular in accordance with still another embodiment of the present invention.
Figure 5A:
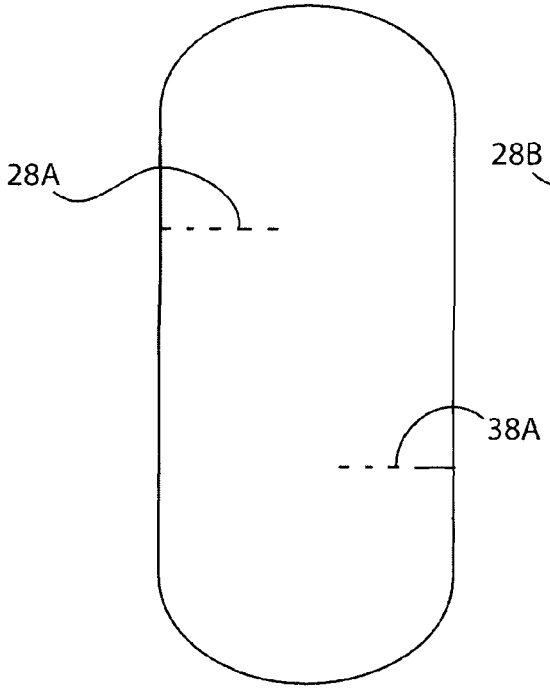
FIG. 5A is a plan view of an accessory pad having slits cut therein in accordance with another embodiment of the present invention.
Figure 5B:
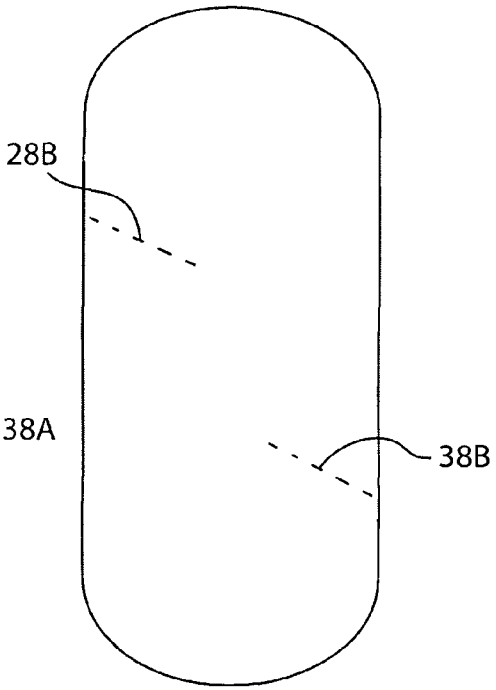
FIG. 5B is a plan view of an accessory pad having angled slits cut therein accordance with yet another embodiment of the present invention.

Although the present invention has been described for a pad having semi-circular cuts formed therein, other types of "cuts" could also be used. For example, FIG. 3 illustrates the use of rectangular notches 24 and 34; FIG. 4 illustrates the use of triangular notches 26 and 36; FIG. 5A illustrates the use of simple slits (indicated by dashed lines 28A and 38A) that are substantially perpendicular to edges 20 and 30, respectively; and FIG. 5B illustrates the use of slits 28B and 38B that are angularly disposed with respect to edges 20 and 30, respectively.

Figure 6:
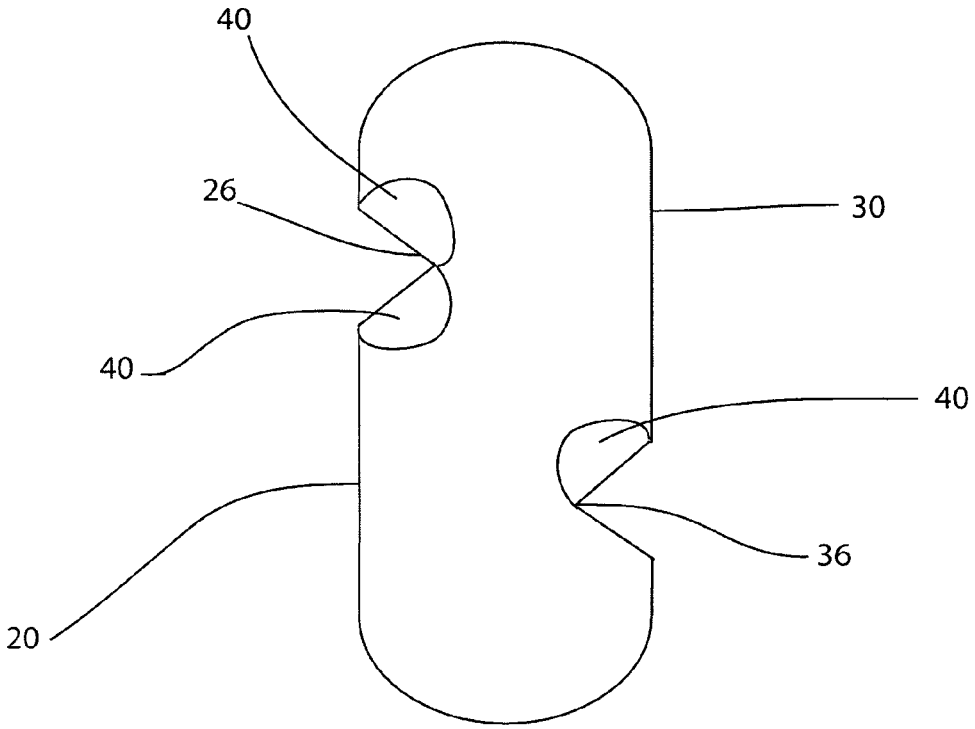
FIG. 6 is a plan view of an accessory pad further having a flap attached to a triangular cut in accordance with another embodiment of the present invention.

In each of the above-described embodiments, the cuts used are identically sized and shaped. However, the present invention is not so limited as FIG. 6 illustrates another embodiment of the present invention having a triangular notch 26 formed in edge 20 and a triangular notch 36 formed in edge 30. In addition, one or more flaps of material 40 can be coupled to one (or both) of notches 26 and 36. As illustrated, two flaps 40 are coupled to notch 26 while only one flap 40 is coupled to notch 36 on one side thereof. Flap(s) 40 serves to cover the body portion (or clothing covering the body portion) engaged by notches 26 or 36.

Figure 7:
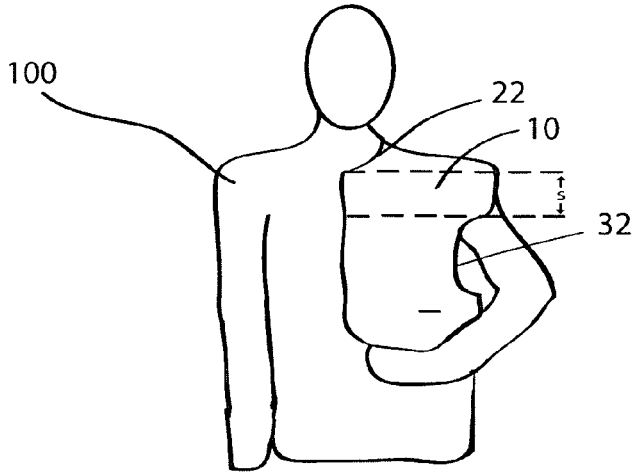
FIG. 7 is a schematic view of a caregiver with an embodiment of the multi-use accessory pad draped thereon.

Use and advantages of the present invention will be described with the aid of FIG. 7 where pad 10 is draped over the shoulder of caregiver 100. With notches 22 and 32 separated by distance "S" as described above, notch 22 can engage the neck of caregiver 100 while notch 32 can engage the upper or bicep portion of an arm of caregiver 100. In this way, caregiver 100 has head and arm mobility without disturbing pad 10 and pad 10 will readily stay in place once positioned by caregiver 100. Still further, pad 10 can easily be positioned using one hand when caregiver 100 must hold an infant (not shown) using the hand/arm. The 180° in-plane rotatability 10 allows it to be used multiple times between the cleaning thereof. Caregiver 100 can hold an infant (not shown) against pad 10 when burping the infant, or can place the infant's head under pad 10 when nursing the infant. Note that pad 10 can be draped over the left shoulder (as shown) or right shoulder of caregiver 100.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A multi-use accessory for an infant caregiver, comprising:

an elongated fabric pad having first and second opposing edges, said first edge having a single first cut formed therein, said second edge having a single second cut formed therein, said first cut and said second cut positioned at non-mirror-image locations that are along said first edge and said second edge, respectively, and that are relative to a longitudinal axis of said pad that lies between said first edge and said second edge such that 180° of in-plane rotation of said pad causes said first cut and said second cut to exchange said locations, said first cut and said second cut separated by a distance measured along said longitudinal axis wherein, when said pad is draped over a caregiver's shoulder, one of said first cut and said second cut is adapted to cradle a portion of the caregiver's neck while a remaining one of said first cut and said second cut is adapted to cradle an upper portion of the caregiver's arm when the caregiver is supporting an infant against said pad with the arm, wherein said first cut and said second cut cooperate to keep said pad in place during head and arm movement of the caregiver.

2. A multi-use accessory as in claim 1, wherein said fabric pad comprises multiple layers of fabric.

3. A multi-use accessory as in claim 2, wherein each of said layers is absorbent.

4. A multi-use accessory as in claim 2, wherein each of said layers comprises a fabric selected from the group consisting of cotton and blends thereof.

5. A multi-use accessory as in claim 2, wherein said multiple layers include a moisture impermeable layer disposed between moisture absorbent layers.

6. A multi-use accessory as in claim 1, wherein said first cut and said second cut are identically sized and shaped.

7. A multi-use accessory as in claim 1, wherein each of said first cut and said second cut comprises a notch.

8. A multi-use accessory as in claim 7, wherein each said notch is selected from the group consisting of triangular notches, rectangular notches, and semi-circular notches.

9. A multi-use accessory as in claim 1, wherein a portion of said pad forms at least one flap of material at each one of said first cut and said second cut.

10. A multi-use accessory for an infant caregiver, comprising:

a substantially rectangular, multi-layer, moisture-absorbent fabric pad having first and second opposing long-side edges, and having first and second opposing short-side edges, said first long-side edge having a single first cut formed therein, said second long-side edge having a single second cut formed therein, said first cut and said second cut positioned at non-mirror-image locations that are along said first long-side edge and said second long-side edge, respectively, and that are relative to a longitudinal axis of said pad that lies between said first long-side edge and said second long-side edge such that 180° of in-plane rotation of said pad causes said first cut and said second cut to exchange said locations, said first cut and said second cut separated by a distance of approximately 2-4 inches measured along said longitudinal axis, said first cut located a distance $L_1$ from said first short-side edge and said second cut located a distance $L_2$ from said second short-side edge wherein $L_1=L_2$ and wherein, when said pad is draped over a caregiver's shoulder, one of said first cut and said second cut is adapted to cradle a portion of the caregiver's neck while a remaining one of said first cut and said second cut is adapted to cradle an upper portion of the caregiver's arm when the caregiver is supporting an infant against said pad with the arm, wherein said first cut and said second cut cooperate to keep said pad in place during head and arm movement of the caregiver.

11. A multi-use accessory as in claim 10, wherein said pad includes outer layers of material selected from the group consisting of cotton and blends thereof.

12. A multi-use accessory as in claim 10, wherein said first cut and said second cut are identically sized and shaped.

13. A multi-use accessory as in claim 10, wherein each of said first cut and said second cut comprises a notch.

14. A multi-use accessory as in claim 13, wherein each said notch is selected from the group consisting of triangular notches, rectangular notches, and semi-circular notches.

15. A multi-use accessory as in claim 10, wherein said fabric pad includes a moisture impermeable layer disposed between moisture absorbent layers.

16. A multi-use accessory as in claim 10, wherein a portion of said pad forms at least one flap of material at each one of said first cut and said second cut.

17. A multi-use accessory for an infant caregiver, comprising:

an elongated multi-layer fabric pad to include an outer layer of terry cloth material, said pad having first and second opposing edges, said first edge having a single first cut formed therein, said second edge having a single second cut formed therein, said first cut and said second cut being substantially identical in size and shape, said first cut and said second cut positioned at non-mirror-image locations that are along said first edge and said second edge, respectively, and that are relative to a longitudinal axis of said pad that lies between said first edge and said second edge such that 180° of in-plane rotation of said pad causes said first cut and said second cut to exchange said locations, said first cut and said second cut separated by a distance of approximately 2-4 inches measured along said longitudinal axis wherein, when said pad is draped over a caregiver's shoulder, one of said first cut and said second cut is adapted to cradle a portion of the caregiver's neck while a remaining one of said first cut and said second cut is adapted to cradle an upper portion of the caregiver's arm when the caregiver is supporting an infant against said pad with the arm, wherein said first cut and said second cut cooperate to keep said pad in place during head and arm movement of the caregiver.

18. A multi-use accessory as in claim 17, wherein each of said first cut and said second cut comprises a notch.

19. A multi-use accessory as in claim 18, wherein each said notch is selected from the group consisting of triangular notches, rectangular notches, and semi-circular notches.

20. A multi-use accessory as in claim 17, wherein a portion of said pad forms at least one flap of material at each one of said first cut and said second cut.

* * * * *